United States Patent [19]

Kowalski

[11] 4,291,913

[45] Sep. 29, 1981

[54] MANUALLY-OPERATED RECLINING CHAIRS

[75] Inventor: Jerome R. Kowalski, Amsterdam, N.Y.

[73] Assignee: Mohasco, Corp., Amsterdam, N.Y.

[21] Appl. No.: 82,810

[22] Filed: Oct. 9, 1979

[51] Int. Cl.[3] ..... A47C 1/023; A47C 1/037

[52] U.S. Cl. ..... 297/89; 297/68; 297/88; 297/317

[58] Field of Search ..... 297/68, 78, 88, 89, 297/84, 85, 317, 318, 321, 322, 323, 340, 341, 342; 5/13, 44, 12 R, 27, 44 B, 47, 51 F, 51 G, 51 J, 59 B, 59 R; 108/82

[56] References Cited

U.S. PATENT DOCUMENTS

| | | | |
|---|---|---|---|
| 1,366,419 | 1/1921 | Richardson | 5/12 |
| 1,377,605 | 5/1921 | Starks | 297/68 X |
| 1,821,299 | 9/1931 | Ferrlira | 297/318 |
| 2,271,928 | 2/1942 | Niles | 297/317 |
| 2,284,571 | 5/1942 | Heller | 248/424 X |
| 2,314,144 | 3/1943 | Hicks | 108/82 |
| 2,872,260 | 2/1959 | Walter | 108/82 X |
| 3,743,349 | 7/1973 | Crum et al. | 297/85 |
| 3,848,924 | 11/1974 | Shoemaker et al. | 297/434 |

FOREIGN PATENT DOCUMENTS

| | | | |
|---|---|---|---|
| 88759 | 9/1954 | Norway | 297/317 |
| 145481 | 5/1954 | Sweden | 297/317 |

*Primary Examiner*—James T. McCall

*Attorney, Agent, or Firm*—Kirschstein, Kirschstein, Ottinger & Cobrin

[57] ABSTRACT

A trigger handle assembly for a reclining chair which is movable between an end-limiting upright position to an end-limiting fully-reclined position. The handle assembly is operative for affirmatively forwardly driving the linkage system for the chair only as the latter is moved from its initial upright position to an intermediate chair position which is between the two end-limiting chair positions. The body weight of a seated user is then utilized to move the chair from the intermediate chair position to the fully-reclined position without the aid of the handle assembly. The handle assembly disengages from the linkage system when the chair reaches the intermediate position. A handle for the handle assembly is freely returnable by gravity to its initial position.

22 Claims, 11 Drawing Figures

FIG. 1
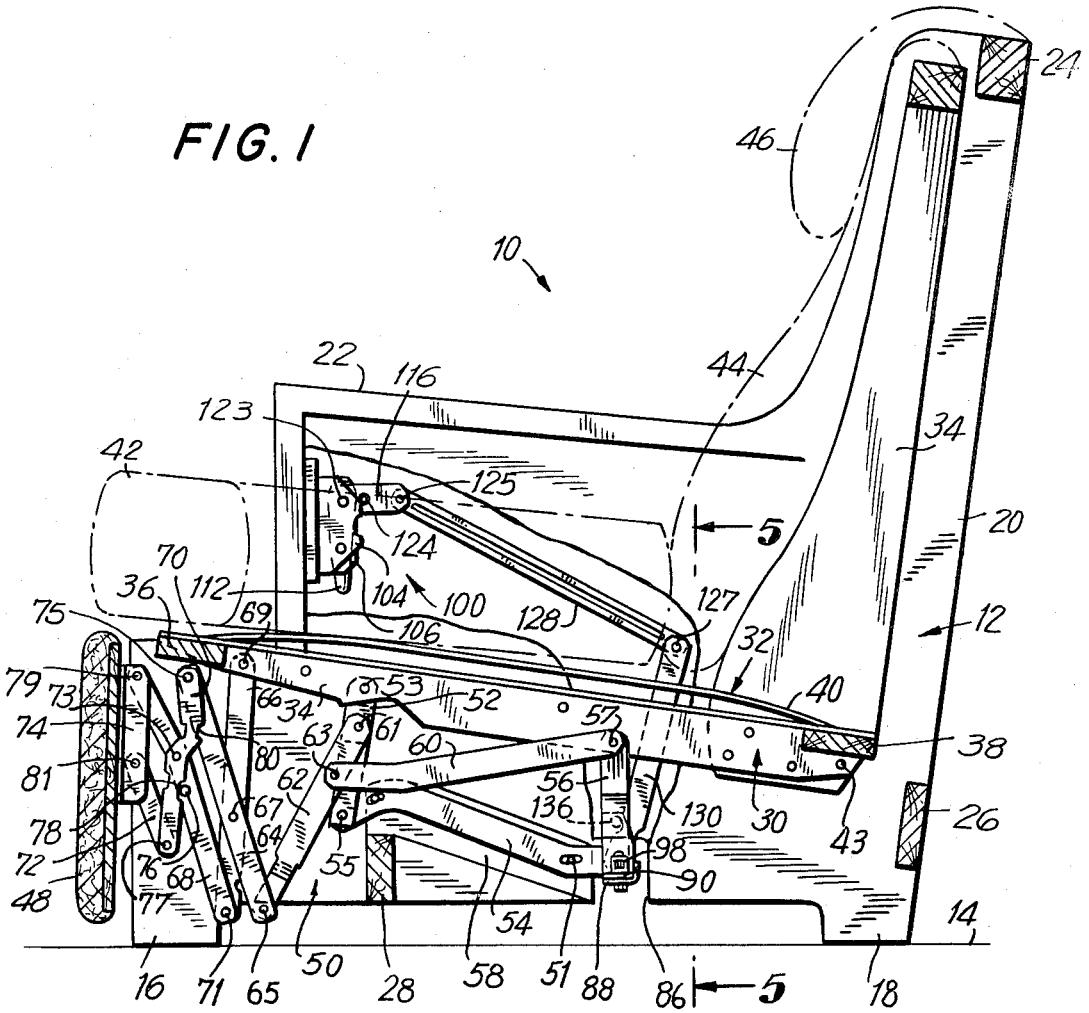
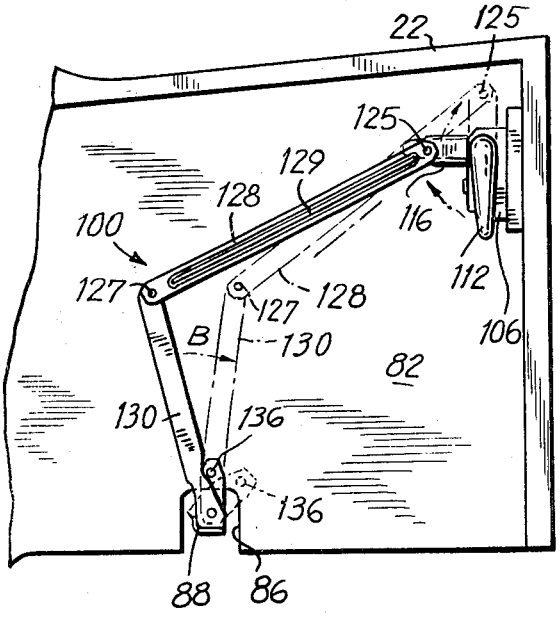
FIG. 3

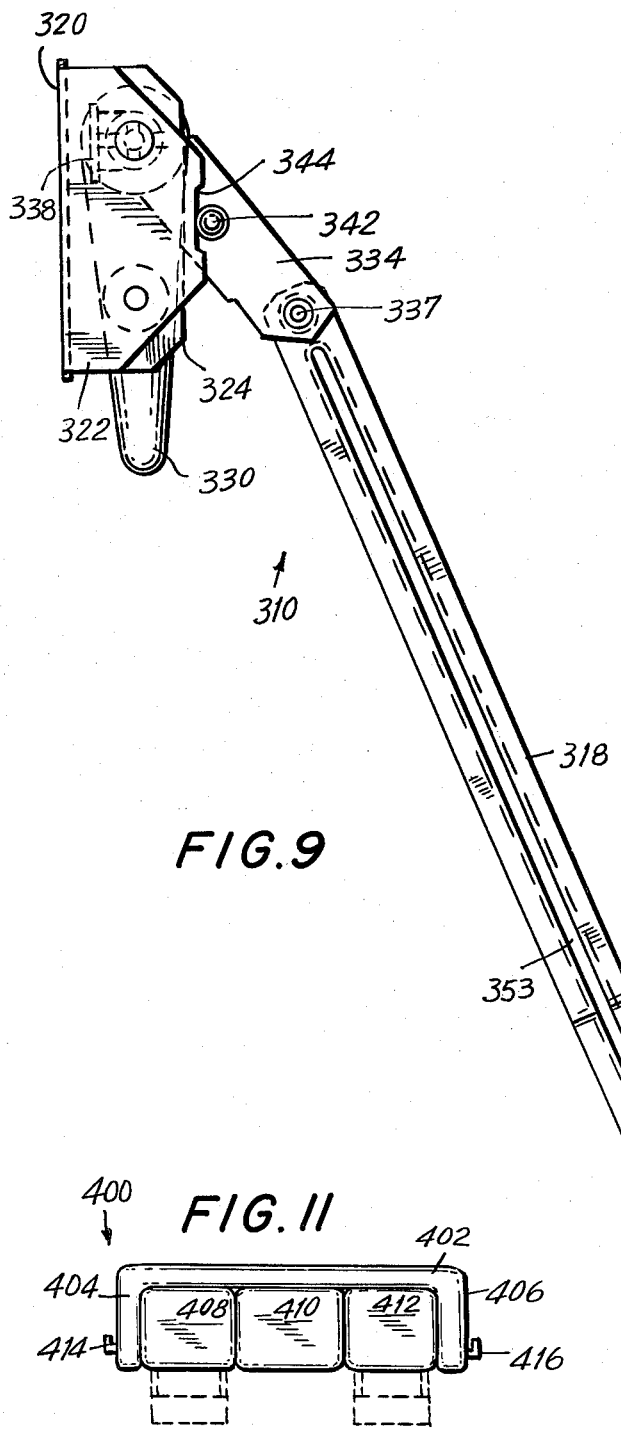
FIG. 9
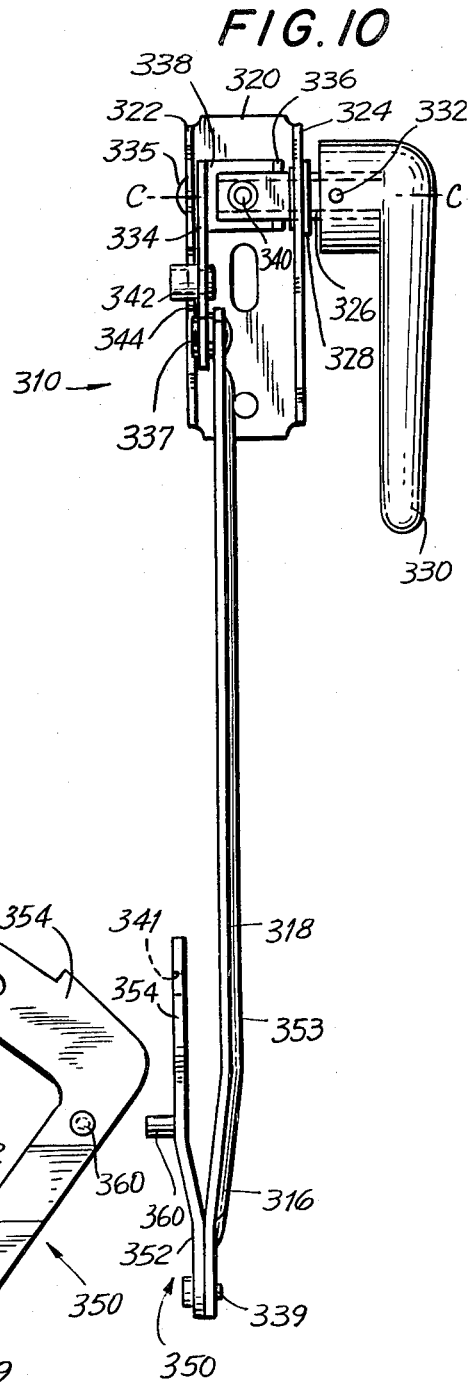
FIG. 10
FIG. 11

MANUALLY-OPERATED RECLINING CHAIRS

BACKGROUND OF THE INVENTION

1. Field of the Invention

The present invention relates generally to the art of reclining chairs and, more particularly, is directed to manually-operated reclining chairs.

2. Description of the Prior Art

Handle-operated reclining chairs are well known in this art. Typically, a handle is mounted within hand-reach of a seated user, and is turned to effect reclining movement of the seat and the backrest from the upright position to the fully-reclined position, and/or to effect extension of the footrest. The prior art handles are also used to return the seat and the backrest from the fully-reclined position back to the upright position, and/or to retract the footrest.

Although generally satisfactory for their intended purpose, the handle for the prior art reclining chair requires a relatively large amount of muscular effort on the occupant's part to both forwardly and rearwardly move the seat, the backrest and the footrest. The prior art handle is kinematically connected to the recliner and the footrest linkage mechanisms of the known reclining chairs such that each position of the handle has a one-to-one correspondence with a distinct position of the chair.

In order to operate the prior art chairs, a relatively long handle is required to reduce the amount of muscular effort otherwise required. However, long massive handles are aesthetically displeasing and also pose a safety hazard.

An incliner is a type of reclining chair which has two positions, i.e. the upright or closed position and the fully-reclined position. Incliners are operated by having the user use his own muscular effort on the armrests to pull himself, the seat, the backrest and the footrest all together forwardly. To the best of my knowledge, none of the present day incliners are handle-operated.

One problem associated with the prior art two-way incliners is that the amount of strength required to recline the chair may be more than users of limited strength, such as children, may possess.

Another problem associated with the currently known incliners is that users are reluctant to buy incliners because they are accustomed to grasping the armrests and pushing themselves rearwardly in order to recline the chair. Users are not yet sufficiently acclimated to incliners which require the user to grasp the armrests and pull himself forwardly in order to recline the chair. Hence, some users are unsatisfied with incliners because they erroneously believe that their incliners are inoperative when they push, rather than pull, on the armrests.

SUMMARY OF THE INVENTION

1. Object of the Invention

Accordingly, it is the general object of the present invention to overcome the aforementioned drawbacks of the prior art.

Another object of the present invention is to reduce the amount of muscular effort required to operate a reclining chair.

Still another object of the present invention is to provide a reliable manually-operated incliner.

Another object of the invention is to shorten the size of the prior art handles to more aesthetic proportions.

Still another object of the present invention is to provide a reclining chair which can be easily opened and closed by persons of limited strength.

A further object of this invention is to provide a reclining chair which has a pull-up handle which duplicates the rearward motion which users are accustomed to applying to operate their reclining chairs.

Still another object of this invention is to provide a novel trigger handle assembly which is durable in construction and easy-to-operate.

2. Features of the Invention

In keeping with these objects and others which will become apparent hereinafter, one feature of the invention resides, briefly stated, in a reclining chair of the type which has a stationary base for supporting the chair on a floor; body-supporting means including a seat located above the base, and a backrest located rearwardly of the seat; an armrest located at a side of the seat; and a recliner system at the armrest. The recliner system kinematically interconnects the body-supporting means to the base for reciprocal movement relative thereto in both the forward and rearward directions along a path which extends between an end-limiting upright chair position and an end-limiting fully-reclined chair position.

In accordance with the improvement of this invention, manually-actuatable means or a trigger handle assembly is provided for moving the recliner system along the path only in the forward direction from the upright chair position towards an intermediate chair position which is located between the end-limiting chair positions.

The handle assembly includes an actuator member or handle mounted on the armrest within hand-reach of a seated user. The handle is displaceable along a working stroke from a first position which corresponds to the upright chair position, to a second position which corresponds to the intermediate chair position. The handle assembly is in force-transmitting relationship with, and affirmatively forwardly drives, the recliner system throughout the displacement of the handle as it is moved from its first towards its second position, thereby forwardly moving the body-supporting means downstream of the path towards the intermediate chair position. The handle assembly is in impositive engagement, and out of force-transmitting relationship with, the recliner system when the handle reaches its second position, thereby disengaging the handle assembly from the recliner system and permitting the latter and the body-supporting means to be moved forwardly further downstream of the path to the fully-reclined position in response to the occupant's body weight acting on the recliner system.

This operation is very advantageous in that the amount of muscular effort required is not high and is easily within the capabilities of persons of limited strength.

After the handle assembly has disengaged from the recliner system, i.e. when the handle has reached its second position, the handle is freely returnable from its second positon to its first position under the influence of gravity. Due to the one-to-one correspondence of the position of the prior art handle to the position of the chair, the prior art handles do not disengage from their respective linkage systems, and therefore do not automatically return to their initial position. The prior art handles which remain extended when the chair is in the fully-reclined position pose a safety hazard which is overcome by the automatic handle return feature of this invention.

Yet another feature of this invention is that a fairly high mechanical advantage is obtained. Shorter handles than have been employed in the prior art can now be used without increasing the muscular effort required to operate the chair.

Still another feature of this invention is that sufficient power can be generated from the trigger handle assembly such that a multiple-seat chair or sofa can be equipped with independently reclinable seats. In the prior art, a user was generally required to grip both armrests of an incliner to pull himself forwardly. Hence, linkage mechanisms for incliners could never be used on sofas whose dimensions permitted the user ready access to only a single armrest, thereby denying the user sufficient leverage to operate the mechanism. However, the trigger handle assembly of this invention does generate sufficient opening force to recline sofa seats of even large sofas with ease.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a partially sectioned side view of one embodiment of a reclining chair in the upright chair position with broken-away portions to show the recliner and footrest linkage systems at the inner wall of the far armrest, and the handle assembly at the outer wall of the far armrest in accordance with the present invention;

FIG. 3 is a side elevational view of the handle assembly mounted on the FIG. 1 embodiment, with solid lines and dashed lines depicting respectively the movement of the handle assembly from the upright chair position of FIG. 1 to the fully-reclined chair position of FIG. 2;

FIG. 9 is a view analogous to FIG. 4 of the handle assembly for the FIG. 6 embodiment;

FIG. 10 is a rear view of the handle assembly of FIG. 9; and

FIG. 11 is a diagrammatic top plan view of a reclining sofa having independently operable handle assemblies in accordance with still another embodiment of the present invention.

DETAILED DESCRIPTION OF THE PREFERRED EMBODIMENTS

Figure 2:
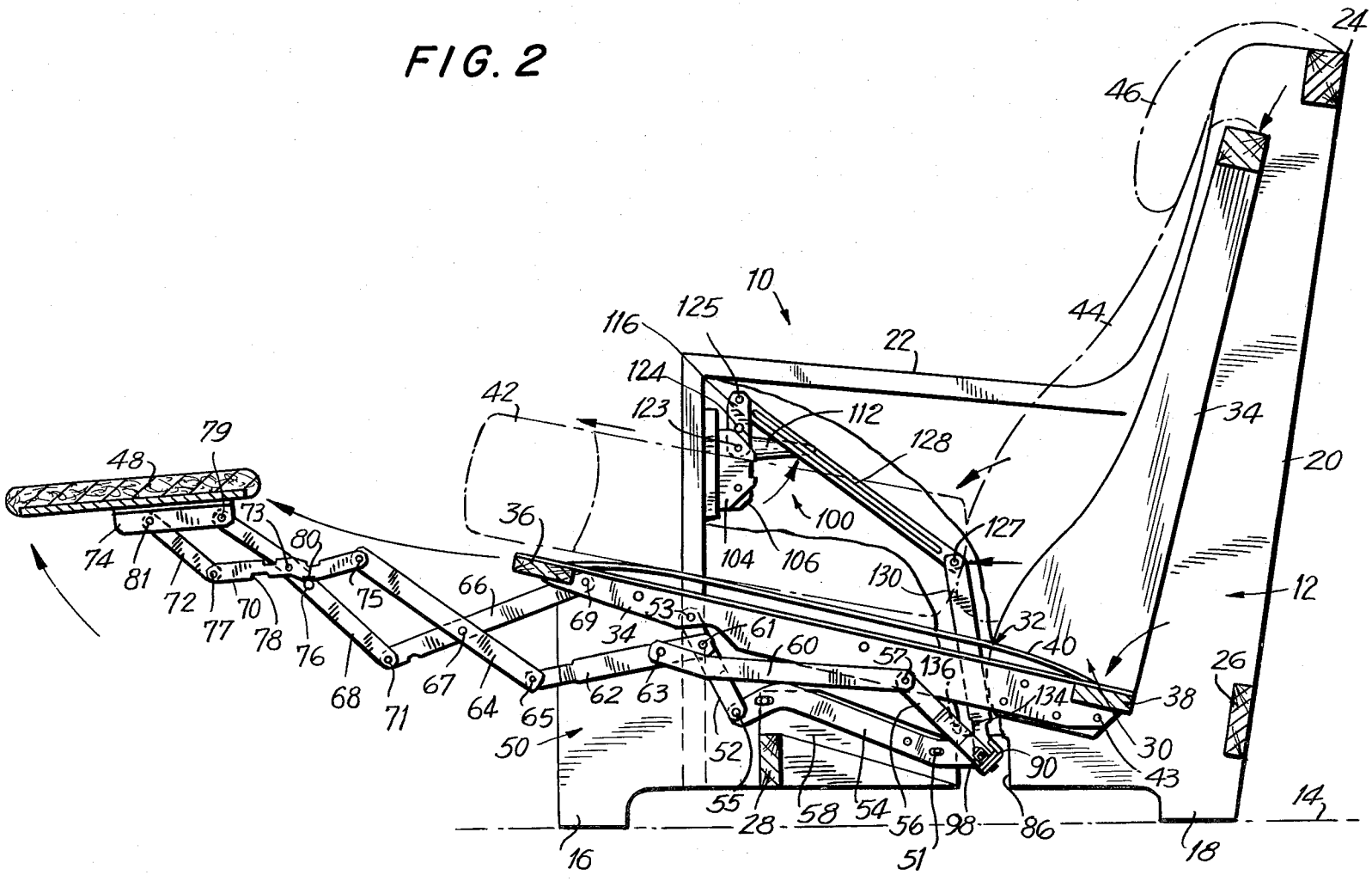
FIG. 2 is a view analogous to FIG. 1, but showing the FIG. 1 embodiment in its fully-reclined chair position.

Referring initially to the reclining chair depicted in FIGS. 1–5, reference numeral 10 generally identifies an embodiment of a reclining chair commonly known as a two-position rester or incliner. The incliner 10 comprises a stationary chair chassis 12 for supporting the incliner on a floor 14. The chassis 12 includes a floor-engaging front base support 16, a floor-engaging rear base support 18, a back support 20, and a high-backed armrest 22 at each side of the chair. To simplify the drawings, only the far armrest, i.e. the armrest at the right side of the chair as considered from the viewpoint of a seated user, has been shown. The high-backed armrests are interconnected by arm cross-rails 24, 26, 28. The armrests 22, the back 20, the front and rear supports 16, 18 and the arm cross-rails 24, 26, 28, are all interconnected and together constitute the stationary chair chassis.

The chair also comprises body-supporting means 30 which includes a seat 32 located generally above the base 16, 18, and a backrest 34 located rearwardly of the seat 32. The seat 32 includes a pair of seat-mounting members 34 (only one shown) at opposite sides of the chair, a front seat cross-rail 36 interconnecting the front ends of the seat-mounting members 34, a rear seat cross-rail 38 interconnecting the rear ends of the seat-mounting members 34, and a set of sinuous seat springs 40 whose opposite ends are respectively connected to the front and rear cross-rails 36, 38. The seat springs 40 are spaced transversely across the chair and form a support surface for the seat cushion 42 shown in phantom lines.

The backrest 34 is fixedly connected to the rear end of each seat-mounting member 34 by fasteners 43 so that the backrest 34 does not move relative to the seat. The backrest cushion 44 and the head cushion 46, both shown in phantom lines, are respectively supported on the backrest 34 and on the chassis 12 in conventional manner. An ottoman or footrest 48 is located at the front of the chair.

An integrated all-linkage system 50 is mounted on each armrest, and kinematically interconnects the body-supporting means 30 and the footrest 48 to the stationary chassis 12. The all-linkage system 50 reciprocally moves the body-supporting means and the footrest relative to the chassis in the forward and rearward directions along a path which extends between an end-limiting upright or closed chair position (FIG. 1) to an end-limiting TV or fully-reclined chair position (FIG. 2). In the upright position, the seat and the backrest are both slightly rearwardly inclined, and the footrest 48 is generally vertically oriented at the front of the chair. In the fully-reclined position, the seat and the backrest are much more rearwardly inclined, and the footrest is extended to a generally horizontal position. The seat, backrest and footrest are all simultaneously moved forwardly away from the stationary chassis by the all-linkage system 50.

The all-linkage system 50 includes a recliner system primarily responsible for moving the body-supporting means, and a footrest drive system primarily responsible for moving the footrest. The recliner system includes a front seat carrier link 52 having its upper end pivotally connected to a forward part of the seat-mounting member 34 at a pivot point 53, and its lower end pivotally connected to a forward part of a stationary chassis-or armrest-mounting member 54 at pivot point 55. The recliner system also includes a rear seat carrier link 56 having an upper end portion pivotally connected to a rearward part of the seat-mounting member 34 at pivot point 57, and a lower end portion pivotally connected to a rearward part of the armrest-mounting member 54 at pivot point 59 (see FIG. 5). The armrest-mounting member 54 is stationarily mounted on the inner armrest wall portion 58 by fasteners 51.

The seat-mounting member 34, the armrest-mounting member 54, and the front and the rear seat carrier links 52, 56 together constitute a four-bar linkage having pivot points 53, 55, 57, 59. In the upright chair position, the elongated front and rear carrier links 52, 56 are generally vertically oriented and, more particularly, the upper pivot points 53, 57 are spaced more closely together than the lower pivot points 55, 59 for greater chair stability. Put another way, the four-bar linkage, as drawn between its pivot points, resembles a trapezoid.

The footrest drive system includes an ottoman push link 60 having its rear end also pivoted at pivot point 57, and its front end pivotally connected to ottoman control link 62 at pivot point 63 which is intermediate the opposite ends of the control link 62. The upper end of control link 62 is pivotally connected to the front seat carrier link 52 at pivot point 61 which is intermediate the opposite ends of the front link 52. The lower end of control link 62 is pivotally connected to the lower end of a first ottoman link 64 at pivot point 65.

The first ottoman link 64 and the second ottoman link 66 constitute a first scissors linkage which are interpivoted intermediate their respective ends at pivot point 67. The upper end of the second ottoman link 66 is pivotally connected to the front of the seat-mounting member 34 at pivot point 69. The lower end of the second ottoman link 66 is pivotally connected to the lower end of a third ottoman link 68 at pivot point 71.

The third ottoman link 68 and the fourth ottoman link 70 together constitute a second scissors linkage which are interpivoted intermediate their respective ends at pivot point 73. The upper end of the fourth ottoman link 70 is pivotally connected to the front end of the first ottoman link 64 at pivot point 75. The lower end of the fourth ottoman link 70 is pivotally connected to an ottoman support link 72 at pivot point 77.

The front end of the third ottoman link 68 is pivotally connected to an upper portion of an ottoman support bracket 74 at pivot point 79. The front end of the ottoman support link 72 is pivotally connected to a lower portion of the ottoman bracket 74 at pivot point 81.

A stop 76 is mounted on the third ottoman link 68, and notches 78, 80 are formed in the side edge of the fourth ottoman link 70. The footrest drive system is stopped at its end-limiting storage position of FIG. 1 when the stop 76 is received in notch 78, engages the side edge of the fourth ottoman link 70, and prevents the latter from moving any further rearwardly. The footrest drive system is stopped at its end-limiting fully-extended position of FIG. 2 when the stop 76 is received in notch 80, engages the side edge of the fourth ottoman link 70, and thereby prevents the latter from moving any further forwardly. Inasmuch as the footrest drive system and the recliner frame are integrated into a unitary system, no other stops are necessary to define the upright and fully-reclined positions. The stop 76 therefore also prevents the recliner system from moving beyond its end-limiting upright and fully-reclined positions.

In accordance with the present invention, manually-actuatable means or trigger handle assembly 100 is provided for moving the all-linkage system 50 forwardly from the upright towards the fully-reclined position. As will be explained in greater detail below, the handle assembly 100 does not affirmatively positively drive the all-linkage system 50 all the way to the fully-reclined position. Instead, the handle assembly 100 is operative only for affirmatively forwardly driving the linkage system to an intermediate chair position which is intermediate the end-limiting chair positions of FIGS. 1 and 2. When the intermediate chair position is reached, the handle assembly 100 is no longer active, and the body weight of a seated user is then conveniently employed as the driving force which moves the chair from the intermediate position to the end-limiting fully-reclined position.

Figure 5:
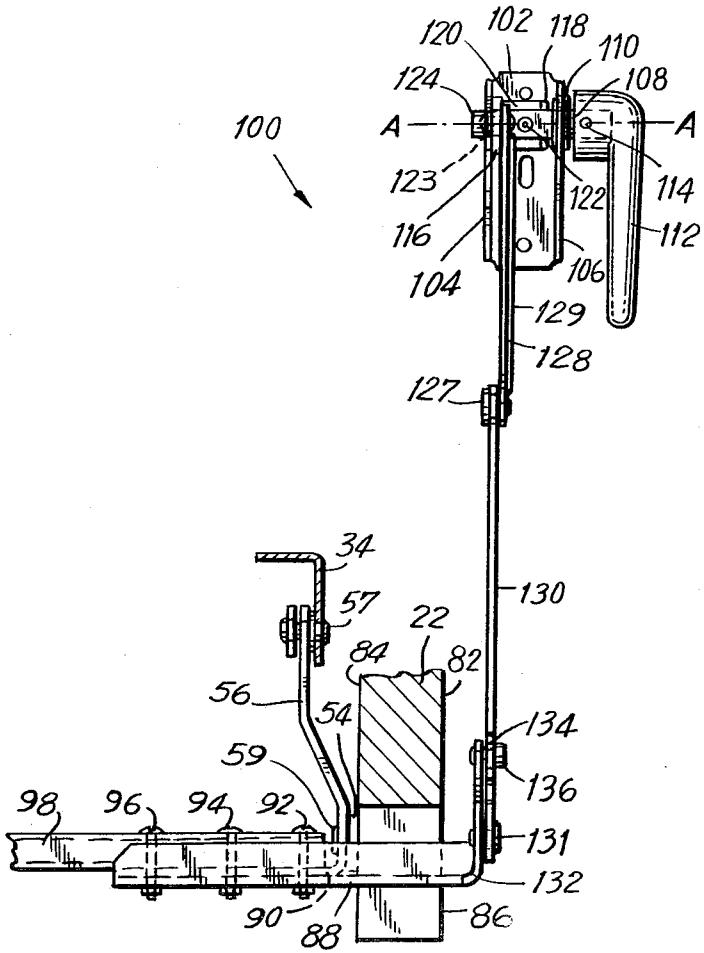
FIG. 5 is a partially broken-away, rear sectional view as taken on line 5—5 of FIG. 1.

As best shown in FIG. 5, the handle assembly 100 is mounted exteriorly of the outside wall 82 of the armrest 22, whereas the linkage system 50 is mounted on the inner wall 84 of the armrest 22. A cut-out 86 is formed through the armrest 22, and an extension member or angle bracket 88 extends through the cut-out. The rear seat carrier link 56 has a lower flange 90 which is fixedly connected by fastener 92 to the extension member 88 for joint movement therewith.

The handle assembly 100 comprises a channel-shaped handle bracket having an armrest-engaging base wall 102 and a pair of side walls 104, 106. A hollow tubular square handle shaft 108 is mounted on and extends through side wall 106 for rotation about pivot axis A—A. A plastic nylon anti-friction bushing 110 journals shaft 108. A pull-up handle or actuator member 112 is fixedly mounted on the outer end of handle shaft 108 by the set screw 114. The handle 112 is elongated and is mounted on shaft 108 so as to extend generally vertically downwardly when the chair is in the upright position.

A handle link 116 is fixedly mounted on the inner end of handle shaft 108 for joint movement therewith. The forward end portion of the handle link 116 is L-shaped, and has a bifurcated tip 118 which engages opposite sides of the square shaft 108, and a flange portion 120 which is fixedly connected to the shaft 108 by fastener 122. The handle link 116 is pivotally connected on side wall 104 at pivot point 123 which lies on the pivot axis A—A.

A stop pin 124 is mounted on the handle link 116 intermediate the opposite ends thereof. The stop pin 124 engages a lower part of the inclined abutment surface 126 of the side wall 104 when the chair is in the upright position, thereby defining a first end-limiting handle position for the handle. The stop pin 124 engages an upper part of the inclined abutment surface 126 when the chair is in the fully-reclined position, thereby defining a second end-limiting handle position for the handle, which now extends horizontally relative to the floor. The arc-length distance through which the handle turns between its end-limiting handle positions is the operating stroke for the handle. In the illustrated embodiment, the operating stroke is preferably on the order of 90°. However, it will be understood that the operating stroke may constitute arc-lengths of either less than 90° or more than 90°. In fact, the arc length may constitute virtually any number of degrees between 0° and 360°.

The rear end of handle link 116 is pivotally connected to the front end of a connector link 128 at pivot point 125. The rear end of the connector link 128 is pivotally connected to the upper end of a drive link 130 at pivot point 127. The connector link 128 is formed with a raised longitudinal embossment for reinforcement purposes. The lower end of drive link 130 is pivotally connected to a flange portion 132 at pivot point 131. The flange portion 132 is of one-piece with the extension member 88.

The drive link 130 is formed with a notch 134 intermediate its opposite pivot points 127, 131. A driven member of force-transmitting pin 136 is mounted on the flange portion 132, and is received in notch 134 and physically engages the drive link 130 when the chair is in the upright position.

The handle assembly operates as follows: As the pull-up handle 112 is turned about the pivot axis A—A from its vertical towards its horizontal orientation, the handle link 116 participates in this turning movement due to the fixed mounting of the latter to the handle 112. As best shown in FIG. 3, the handle link 116 transmits the turning force to the connector link 128 and, in turn, to the drive link 130 which is pulled forwardly in direction of the arrow B. As the drive link is being pulled forwardly by being pivoted about pivot point 131, the drive pin 136, which is in physical force-transmitting contact with the drive link at this time, is likewise pushed forwardly. As the drive pin 136 is being forwardly moved, the flange 132, the extension member 88 and the rear seat carrier link 56, all of which are interconnected in force-transmitting relationship, are likewise being forwardly pushed as a unit.

Since the lower end of the rear seat carrier link 56 cannot move relative to the stationary armrest member 54 at pivot point 59, the upper end of the rear carrier link at pivot point 57 is free to move forwardly due to the forwardly-acting force transmitted by the drive link 130. The rear seat carrier link 56 tilts forwardly, thereby causing the seat 32 to move forwardly and concomitantly, the upper end of the front seat carrier link 52 at pivot point 53 moves forwardly. As noted above, the four-bar linkage 52, 54, 56, 34 has a generally trapezoidal-like configuration wherein the front and rear seat carrier links 52, 56 are generally vertically oriented when the chair is in the upright position. When the chair reaches the fully-reclined position, the front and rear seat carrier links are tilted far forwardly, and the four-bar linkage at this time has a collapsed parallelogram-like configuration.

As the four-bar linkage is moving from its FIG. 1 position towards its FIG. 2 position, eventually an intermediate position is reached where the body weight of a seated user takes over and moves the front and rear carrier links 52, 56 forwardly without the aid of the force transmitted by the drive link 130. The user's weight acts downwardly on the seat mounting member of the four-bar linkage somewhere in the vicinity of the pivot point 57, and acts to further tilt the front and rear carrier links.

Once the user's weight takes over the primary responsibility for moving the chair from the intermediate chair position to the fully-reclined position, the rear seat carrier link 56 and all the parts connected in force-transmitting relationship therewith are likewise moved forwardly. This means that the extension member 88, the flange 132, and the driven pin 136 all move forwardly. Thus, the pin 136 becomes disengaged from the drive link 130 at the intermediate chair position. The user can now let go of the handle 112 which thereupon will freely return under the influence of gravity to its original vertical orientation.

Put another way, the handle 112 moves along a working stroke from a first position which corresponds to the upright chair position, to a second position which corresponds to the intermediate chair position. The first position corresponds to the aforementioned first end-limiting handle position. The second position is located somewhere between the aforementioned first and second end-limiting handle positions. The working stroke is shorter than the operating stroke. In the illustrated embodiment where the operating stroke is approximately 90°, the operating stroke can range from approximately 30° to about 45°. It will be understood that these arc-lengths are merely exemplary, and that any arc-length could have been chosen for the operating stroke. Indeed, in some cases, it may be desirable to make the operating stroke to have the same length as the working stroke, in which case the second position would be located at the aforementioned second end-limiting handle position.

The handle assembly 100 is thus in force-transmitting relationship with, and affirmatively forwardly drives, the recliner system throughout the displacement of the handle 112 as it is being displaced from its first position towards its second position. Specifically, the drive link 130 physically engages and drives the driven pin 136 through the entire displacement of the handle from its first position until just before it reaches its second position. The seat and the backrest are both forwardly moved all during the displacement of the handle from its first towards its second position.

Simultaneously, the footrest 48 is moved forwardly when the handle is moved from its first towards its second position. As the rear seat carrier link 56 is tilted forwardly, the ottoman push link 60 is driven forwardly and, in turn, the ottoman control link 62 is pivoted about pivot point 63 such that its lower pivot point 65 moves forwardly and upwardly. The control link 62 causes the first and second scissors linkages to open in conventional fashion, thereby extending the footrest 48 forwardly and upwardly.

Once the handle 112 reaches its second position, the user's body weight takes over to forwardly drive the recliner system and the footrest system to the fully-reclined position. Specifically, the driven pin 136 physically disengages from the drive link 130, as best shown in FIG. 2. Put another way, the drive link 130 is in impositive engagement with, and out of force-transmitting contact with, the driven pin 136. The seat, the backrest and the footrest are thereby still further forwardly moved simultaneously at this time due to the user's body weight.

A linkage system 50 is mounted at the inner wall of each armrest 22 and, in order to insure joint simultaneous movement of both linkage systems, a force-transmitting hollow tubular cross-shaft 98 (see FIG. 5) of square cross-section extends transversely across the underside of the seat. One end of the cross-shaft 98 is connected to the extension member 88 by fasteners 96, 94, 92, at least some of which also extend through the lower flange 90 of the rear seat carrier link 56, and the other non-illustrated end is similarly connected to the opposite linkage system. As noted above, the rear seat carrier link 56 is supported by the chair structure by being connected at its lower end at pivot 59 to the armrest-mounting member 54, and at its upper end at pivot 57 to the seat-mounting member 34. Hence, the cross-shaft 98 and extension member 88 which are connected to flange 90 of the rear seat carrier link 56 are similarly supported by the seat-mounting member 34 and the armrest-mounting member 54.

The linkage systems at each side of the chair are mirror symmetrical. To decrease manufacturing costs, at least some of the links are manufactured so that they can be used on either the right or the left linkage system. For example, ottoman link 70 is provided with the aforementioned notches 78, 80 on one side edge and with a corresponding set of notches at its other side edge. Also, drive link 130 is provided with notch 134 at one side edge and with a corresponding notch at its other side edge. It will be understood that these links can be inverted for use on either the right or the left linkage system.

Figure 4:
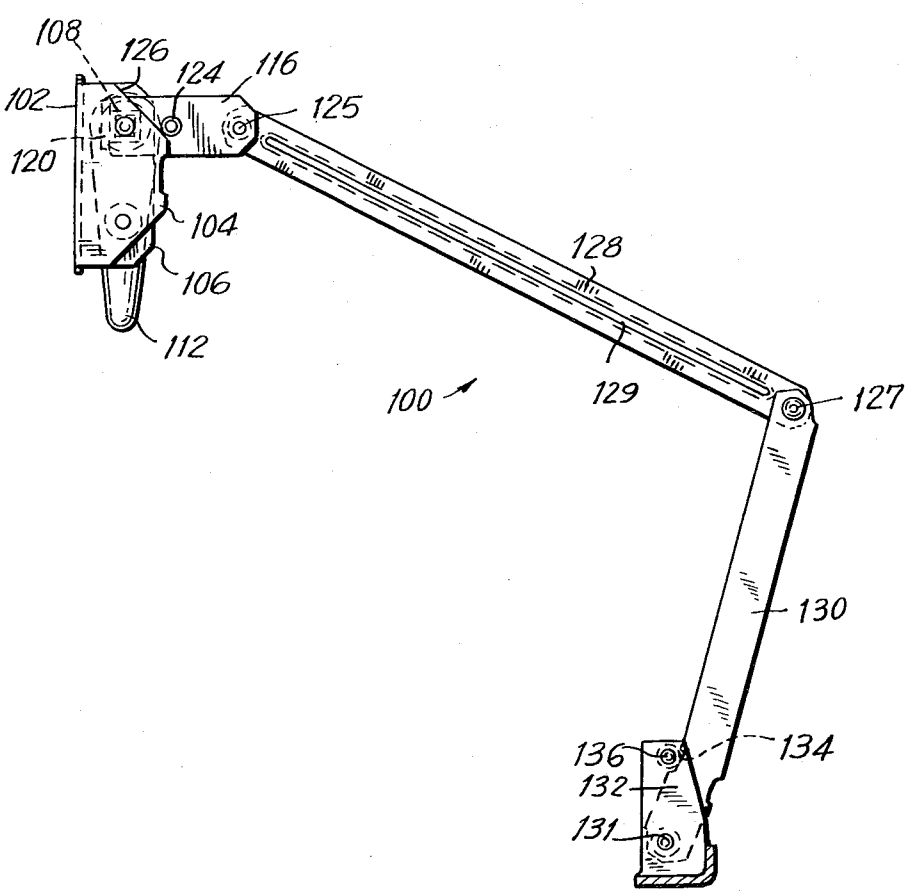
FIG. 4 is an enlarged side elevational view of the handle assembly for the FIG. 1 embodiment.

Another feature of the handle assembly 100 is that a considerable mechanical advantage is obtained when the various links are dimensioned and oriented in the manner shown in FIG. 4. As best shown in FIG. 3, the length of the handle 112 is considerably shorter than the length of the drive link 130. Moreover, the drive link 130 moves through a considerably shorter angular distance as compared to the distance through which the handle moves. The mechanical advantage can be measured by drawing an imaginary line lengthwise along the inclined connector link 128, and thereupon by drawing perpendiculars from the pivot point 131 and also from the pivot point 123 to the imaginary line. The ratio of the lengths of these penpendicular lines represents the mechanical advantage. In accordance with this invention, the length of the handle has been made very short, on the order of 4", and a mechanical advantage on the order of 4 or more has been obtained. Prior art handles are generally on the order of 9" or more, and therefore the short handle construction of this invention is very advantageous in this art, particularly from an aesthetic point of view.

The chair 10 of FIGS. 1–5 has an alternate mode of operation which is completely independent of the aforementioned operation of the trigger handle assembly. It will be remembered that the armrests 22 and the base supports 16, 18 are interconnected so that the entire chair chassis 12 is stationarily mounted on the floor 14. Hence, the chassis 12 may serve as a reaction member whereby a seated user may pull himself, the recliner system, and the footrest system, all together forwardly out of the upright position. In this alternate operational mode, the handle 112 need not be turned for the user himself supplies the necessary pulling force to move the linkage system to the intermediate chair position, at which position the user's own body weight acts on the linkage system to drive the seat, backrest and footrest to the fully-reclined position as discussed above.

Referring now to the reclining chair depicted in FIGS. 6–10, reference numeral 200 generally identifies another embodiment of a reclining chair variant known as a two-position rester or incliner. The incliner 200 comprises a stationary base 216 at each side of the incliner 200 for supporting the latter on a floor 214, and a movable chair chassis 212 which is movable relative to the base 216. Each base 216 has a floor-engaging front base support 218 and a floor-engaging rear base support 220. Each base 216 is interconnected by base cross-rails 222, 224. A base-mounting link member 226 is stationarily mounted on each base 216 at opposite sides of the chair by fasteners 228, 230.

The movable chair chassis 212 comprises a pair of high-backed armrests 232 which are interconnected by chassis cross-rails 234, 236, 238. The chair 212 also comprises body-supporting means which includes a seat 240 located generally above the base 216, and a backrest 242 located rearwardly of the seat. The seat 240 includes a set of sinuous seat springs 244 each having its opposite ends respectively connected to the front and the rear chassis cross-rails 236, 238. The seat springs 244 are spaced transversely across the chair and form a support surface for the seat cushion 246 and the backrest cushion 248, both shown in phantom lines. A two-part ottoman or footrest 250 consists of an upper footrest part 252 and a lower footrest part 254 which are located generally at the front region of the chair.

In the first embodiment depicted in FIGS. 1–5, the high-backed armrests 22 were stationarily mounted on the base to thereby constitute a stationary chair chassis. The seat and the backrest of the first embodiment constituted a separate frame which moved reciprocally relative to the stationary chair chassis, thereby constituting a so-called frame-within-a-frame construction.

Figure 6:
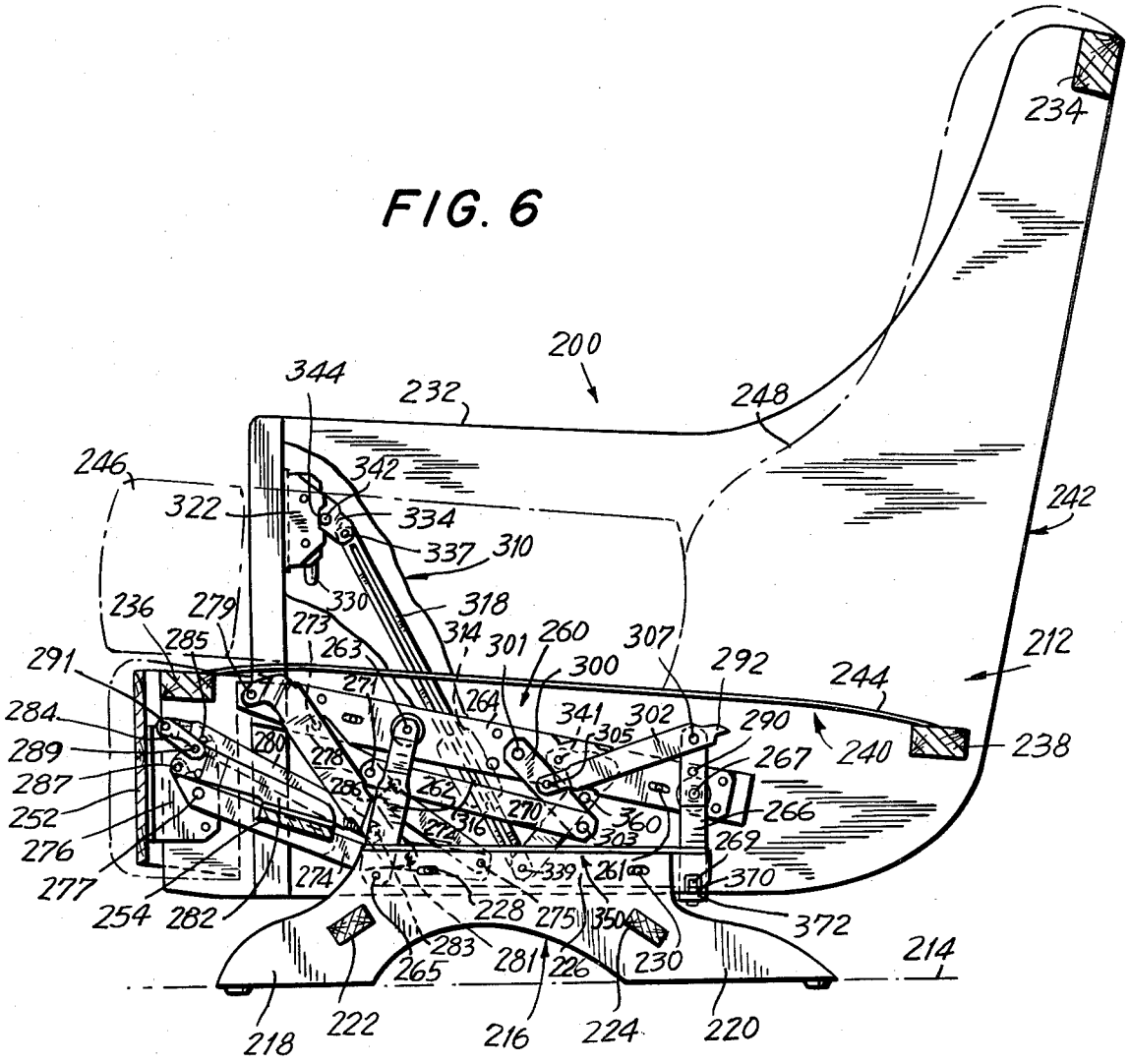
FIG. 6 is a view analogous to FIG. 1 of another embodiment of a reclining chair in the upright chair position in accordance with this invention.
Figure 7:
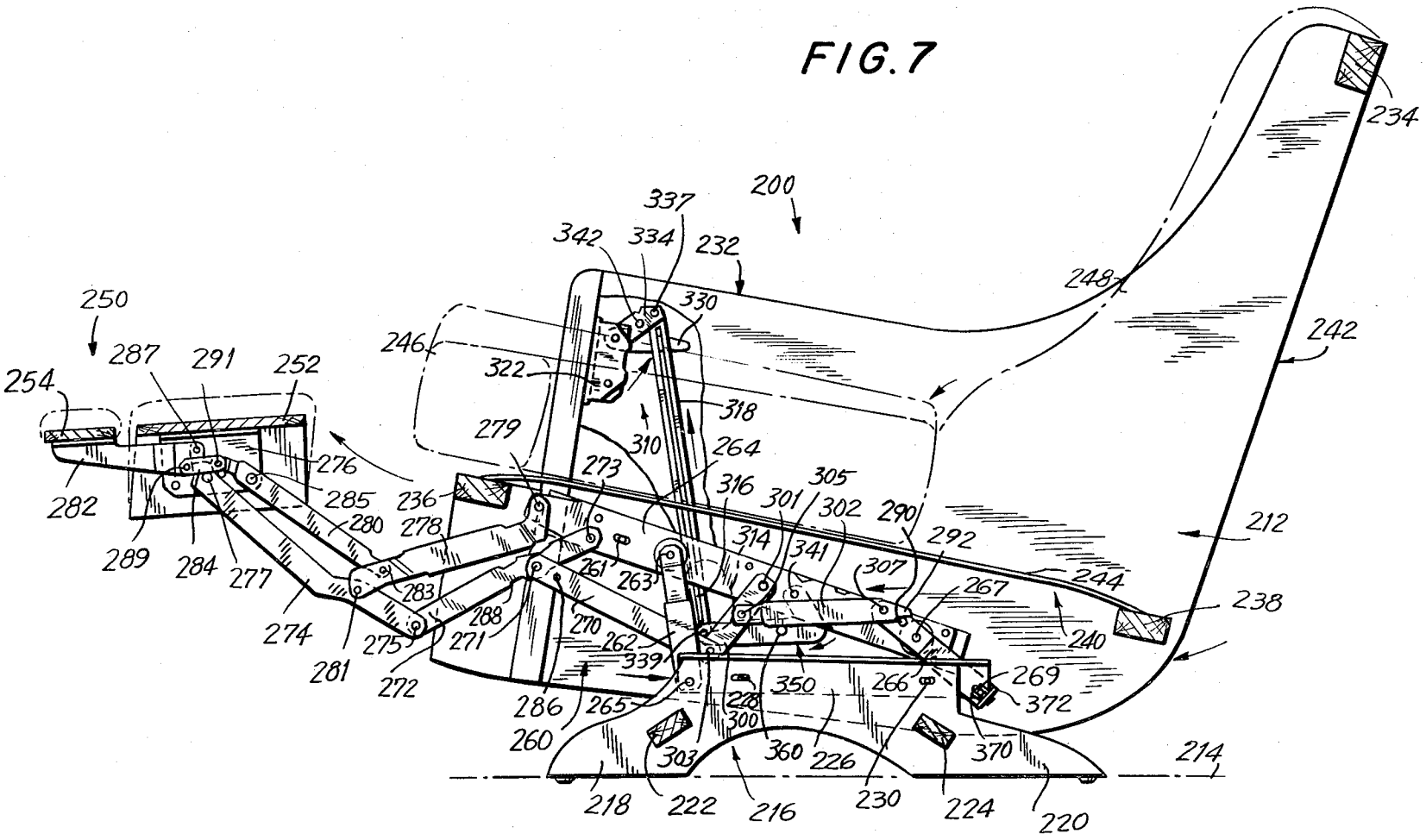
FIG. 7 is a view analogous to FIG. 2 of the FIG. 6 embodiment in the fully-reclined chair position.

However, in the second embodiment depicted in FIGS. 6–10, the seat, the backrest and the armrests are all interconnected to thereby constitute a chair chassis which is movable as a unit relative to the base. This is known as a single frame chair construction. The second embodiment now under discussion is also a wall proximity chair in the sense that the back thereof never physically strikes a rear wall behind the chair as the backrest is reclined from its upright chair position (FIG. 6) to its fully-reclined position (FIG. 7).

An integrated all-linkage system 260 is mounted at each armrest, and kinematically interconnects the seat 240, the backrest 242 and the footrest 250 to the stationary base 216. The linkage system 260 reciprocally moves the seat, backrest, and footrest forwardly and rearwardly along a path which extends from the end-limiting upright or closed chair position of FIG. 6 to the end-limiting fully-reclined chair position of FIG. 7 in a progressive manner. In the upright position, the seat and the backrest are slightly rearwardly inclined, the upper footrest part 252 is generally vertically oriented at the front of the chair, and the lower footrest part 254 is folded up behind the upper footrest part 252. In the fully-reclined position, the seat and the backrest are much more rearwardly inclined, and the two footrest parts are extended to a generally horizontal orientation. The seat, backrest, footrest and the armrests are all continuously moved forwardly away from the base 216.

The all-linkage system 260 includes a recliner system primarily responsible for moving the body-supporting means, and a footrest drive system primarily responsible for moving the footrest. The recliner system includes front seat carrier link 262 having its upper end pivotally connected to a forward part of a chassis- or seat-mounting member 264 at pivot point 263, and its lower end is pivotally connected to a forward part of the base-mounting member 226 at pivot point 265. The recliner system also includes a rear seat carrier link 266 having an upper intermediate part pivotally connected to a rearward part of the seat-mounting member 264 at pivot point 267, and a lower end part pivotally connected to a rearward part of the base-mounting member 226 at pivot point 269 (see FIG. 8). The seat-mounting member 264 is stationarily mounted on the inner armrest wall of each armrest 232 by means of fasteners 261.

The seat-mounting member 264, the base-mounting member 226, and the front and the rear seat carrier links 262, 266 together constitute a four-bar linkage having pivot points 263, 265, 267, 269. In the upright position, the elongated front and rear seat carrier links 262, 266 are generally vertically oriented and, more particularly, the upper pivot points 263, 267 are spaced more closely together than the lower pivot points 265, 269 for greater chair stability. The rear carrier link 266 is more vertically oriented than the front carrier link 262 which is slightly rearwardly inclined in the upright chair position. As illustrated in FIG. 6, the four-bar linkage resembles a trapezoid.

The footrest drive system includes an ottoman push link 270 having its front end pivotally connected to an intermediate part of the ottoman control link 272 at pivot point 271. The upper end of control link 272 is pivotally connected to the front of the seat-mounting member 264 at pivot point 273. The lower end of control link 272 is pivotally connected to the rear end of a first ottoman link 274 at pivot point 275. The forward end of the first ottoman link 274 is pivotally connected to a lower part of the upper ottoman bracket 276 at pivot point 277.

An upper end of a second ottoman link 278 is pivotally connected to the front end of seat-mounting member 264 at pivot point 279. The lower end of the second ottoman link 278 is pivotally connected to an intermediate part of the first ottoman link 274 at pivot point 281. The rear end of a third ottoman link 280 is pivotally connected to an intermediate part of the second ottoman link 278 at pivot point 283. The front end of the third ottoman link 280 is pivotally connected to an upper part of the upper ottoman bracket 276 at pivot point 285.

The upper ottoman part 252 is mounted on the upper ottoman bracket 276. The lower ottoman part 254 is mounted on a lower ottoman bracket 282. The lower ottoman bracket 282 is pivotally connected to a forward extension of the first ottoman link 274 at pivot point 287. The lower end of a short flipper link 284 is pivotally connected to the lower ottoman bracket 282 at pivot point 289. The upper end of the flipper link 284 is pivotally connected to a forward extension of the third ottoman link at pivot point 291.

A stop pin 286 (see FIG. 7) is mounted on the push link 270, and a notch 288 is formed on the inner side edge of the control link 272. When the stop 286 engages the notch 288, the footrest drive system as well as the recliner system are stopped in the upright chair position.

The footrest drive system is moved forwardly by an idler link 300 whose upper end is pivotally connected to a central part of the seat-mounting member 264 at pivot point 301, and whose lower end is pivotally connected to the rear end of the ottoman push link 270 at pivot point 303. The forward end of a rear drag link 302 is pivotally connected to a central part of the idler link 300, and the rear end of the drag link 302 is pivotally connected to an upper extension of the rear seat carrier link at pivot point 307. The idler link 300 and the rear drag link 302 together constitute a driven link subassembly which interconnects the footrest drive system and the recliner system.

A stop pin 290 is mounted on an upper extension of the rear seat carrier link 266. Stop pin 290 abuttingly engages a rear extension 292 of the drag link 302, and stops the all-linkage system in the fully-reclined position of FIG. 7.

As the idler link 300 is pivoted about pivot point 301, both the footrest drive system and the recliner system are simultaneously moved forwardly in a continuous manner. Specifically, as the pivot point 303 at the end of the idler link is moved forwardly, the footrest drive system is moved forwardly due to force transmission along the ottoman push link 270. Concomitantly, as the pivot point 305 at the central part of the idler link is moved forwardly, the recliner system is moved forwardly due to force transmission along the rear drag link 302. The idler link 300 is moved forwardly by operation of the manually-actuatable means or trigger handle assembly 310.

In accordance with this invention, the handle assembly 310, just like the handle assembly 100, is operative for moving the all-linkage system 260 forwardly from the upright chair position of FIG. 6 towards the fully-reclined position of FIG. 7. As before, the handle assembly 310 does not affirmatively and positively drive the linkage system 260 all the way to the fully-reclined position, but instead only affirmatively drives the linkage system 260 to an intermediate chair position. At this intermediate chair position, the handle assembly 310 is not longer active, and the body weight of the seated user is then utilized as the primary driving force for moving the chair from the intermediate to the fully-reclined position.

Figure 8:
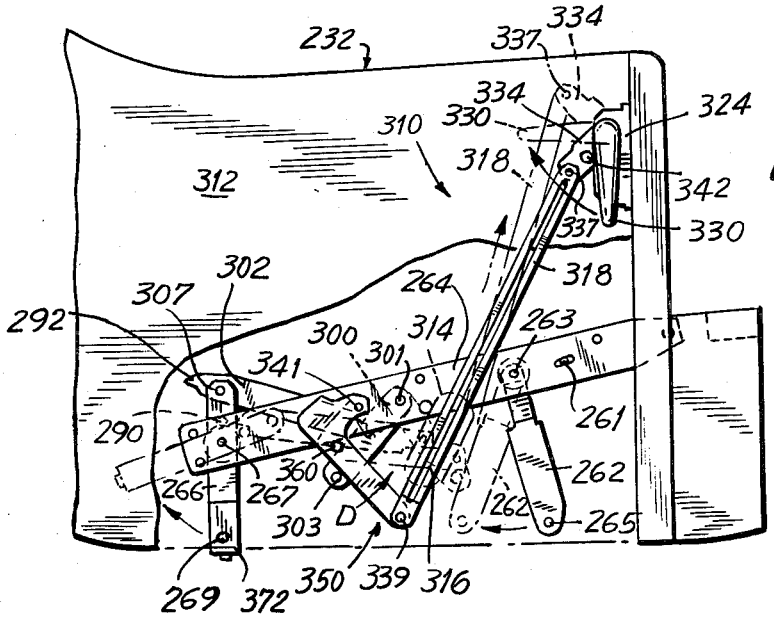
FIG. 8 is a view analogous to FIG. 3 of the handle assembly for the FIG. 6 embodiment.

As shown in FIG. 8, the handle assembly 310 is mounted so that part of it is mounted exteriorly of the ouside wall 312 of the armrest 232, and the remaining part is mounted interiorly of the armrest 232. A cut-out 314 extends through the armrest 232, and an offset or extension portion 316 of the connector link 318 extends transversely through the cut-out 314.

The handle assembly 310 comprises a channel-shaped handle bracket having an armrest-engaging base wall 320 and a pair of side walls 322, 324. A hollow tubular square handle shaft 326 is mounted on and extends through the side wall 324 for rotation about pivot axis C—C. A plastic nylon anti-friction bushing 328 journals the shaft 326. A pull-up handle or actuator member 330 is fixedly mounted on the outer end of shaft 326 by set screw 332. The elongated handle is mounted on shaft 326 so as to extend generally vertically downwardly when the chair is in its upright position.

A handle link 334 is fixedly mounted on the inner end of handle shaft 326 for joint movement therewith. The forward end of handle link 334 is L-shaped, and has a bifurcated tip 336 for engaging opposite sides of shaft 326, and a flange 338 which is mounted on the shaft 326 by fastener 340. The handle link 334 is pivotally mounted on side wall 322 at pivot point 335 which lies on pivot axis C—C. A stop pin 342 is mounted on the link 334 intermediate the opposite ends thereof, and engages the abutment surface 344 of the side wall 322 when the chair is in the upright position to thereby define a first end-limiting handle position for the handle, as shown in FIG. 6. A second end-limiting handle position is illustrated in FIG. 7 which corresponds to the fully-reclined chair position. The operating stroke for the handle as measured between its end-limiting handle positions is on the order of 90°, although it will be understood that operating strokes having arc-length distances of either less than, or more than, 90° could also be chosen.

The rear end of handle link 334 is pivotally connected to the front end of connector link 318 at pivot point 337. The rear end of connector link 318 is pivotally connected to the lower arm 352 of the drive link or bell-crank 350 at pivot point 339. The connector link 318 is reinforced with a longitudinally raised embossment 353. The upper arm 354 of the bell-crank 360 is pivotally connected to the seat-mounting member 264 (see FIG. 8) at pivot point 341. A drive member of force-transmitting pin 360 is mounted on the lower arm 352 just below the junction of the two arms. As shown in FIG. 6, the drive pin 360 physically engages the idler link 300 at a contact zone which is below and behind pivot points 301 and 305, but above and behind pivot point 303, when the chair is in the upright position.

The handle assembly operates as follows: As the pull-up handle 330 is turned about pivot axis C—C, the handle link 334 is likewise turned about its pivot point 335. This turning force lifts the connector link 318 upwardly which, in turn, pivots the drive bell-crank link 350 in the direction of the arrow D in FIG. 8 about the pivot point 341. This rotation of the bell-crank 350 causes the drive pin 360 to likewise orbit in the same direction along the arrow D in FIG. 8 about pivot point 341. Due to the force-transmitting engagment between the drive pin 360 and the idler link 300, the idler link is pushed forwardly so that its lower pivot point 303 is orbited about the pivot point 301.

As noted above, when the idler link is driven forwardly, the ottoman push link 270 is driven forwardly to extend the footrest 250. Concomitantly, the rear seat carrier link 266 is tilted forwardly due to the pulling force exerted by the rear drag link 302. The rear seat carrier link acts on the four-bar linkage defined by pivot points 263, 265, 267, 269 and thereby causes the front seat carrier link 262 to likewise tilt forwardly. Again, as in the last embodiment, the orientation of the links changes from the more upright trapezoidal configuration of FIG. 6 towards the more collapsed parallelogram-like configuration of FIG. 7.

As the four-bar linkage is being collapsed, an intermediate position is eventually reached where the body weight of the occupant takes over and assumes primary responsibility for forwardly tilting the front and rear seat carrier links without the aid of the force being transmitted from the drive pin 360. The occupant's weight acts generally downwardly on the four-bar linkage somewhere in the vicinity of pivot point 307.

Once the occupant's weight takes over, the idler link moves away from the drive pin 360. At the aforementioned intermediate chair position, the idler link 300 disengages from the drive pin 360. The user can at this time release the handle which thereupon returns by gravity to its initial vertical orientation.

As before, the working stroke is defined as the arc-length distance of the handle from its first position, which corresponds to the position of the handle in the upright chair position, to a second position, which corresponds to the handle position in the intermediate chair position, i.e. when the idler link disengages from the drive pin. The working stroke may be the same length as the operating stroke, but preferably is less than the operating stroke and can range from about 30° to about 45° in a preferred embodiment.

To summarize, the handle assembly 310 is in force-transmitting engagement with, and affirmatively forwardly drives, the all-linkage system 260 throughout the displacement of the handle from its first towards its second position. Specifically, the drive pin 360 physically engages the idler link 300 through this entire period of time until just before the handle reaches its second position. Once the handle reaches the second position, the occupant's weight takes over and forwardly drives the linkage system from the intermediate to the fully-reclined position. Specifically, the drive pin 360 is in non-positive engagement and out of force-transmitting relationship with the idler link 300. As shown in FIG. 7, the drive pin 360 is spaced away from the idler link. Thus, the seat, the backrest and the footrest are all simultaneously moved forwardly from the upright to the fully-reclined position. The fully-reclined position and the second handle position are defined when the stop 290 on the rear seat carrier link abuts against the rear extension 292 of the drag link 302.

Another linkage system is mounted on the armrest located at the opposite side of the chair. In order to insure joint movement of both linkage systems, a force-transmitting hollow tubular cross-shaft 370 of square cross-section extends transversely across the underside of the seat. One end of the cross-shaft 370 is connected to a flange 372 which is of one-piece with the rear seat carrier link 266. The opposite end of the cross-shaft 370 is securely connected to a corresponding flange on the other non-illustrated linkage system.

The linkage system 260 and the handle assembly 310 need not be mounted on a stationary base 216, but can equally well be utilized on a rocker-recliner chair. Moreover, the first embodiment of FIGS. 1–5 and the second embodiment of FIGS. 6–10 are not intended to be limited to two-way resters, i.e. chairs in which the backrest does not move relative to the seat. The present invention can likewise be utilized with three-way chairs, particularly three-way wall proximity reclining chairs where the backrest moves relative to the seat.

FIG. 11 illustrates a top plan view of still another embodiment of the invention, specifically a reclining sofa 400. The sofa has a stationary chassis comprised of a back 402 and two side armrests 404, 406. A plurality of body-supporting means or seats 408, 410, 412 are successively located between the two armrests.

Seats 408 and 412 are movable from an upright to a fully-reclined position, as diagrammatically illustrated by dashed lines, by trigger handle assemblies 414, 416, respectively. Handle assemblies 414, 416 are mounted on adjacent armrests 404, 406. Each trigger handle assembly 414, 416 is identical to the one illustrated and described in connection with the first embodiment of FIGS. 1–5 herein, and hence will not be repeated for the sake of brevity. Seats 408, 412 are independently movable by their respective handle assemblies, whereas seat 410, which is not provided with any handle assembly, remains stationary.

It will be understood that each of the elements described above, or two or more together, may also find a useful application in other types of constructions differing from the types described above.

While the invention has been illustrated and described as embodied in manually-operated reclining chairs, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features, that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In a reclining chair of the type having (A) a stationary base for supporting the chair on a floor;

(B) body-supporting means including a seat located generally above the base, and a backrest located rearwardly of the seat;

(C) an armrest located at a side of the seat;

(D) a recliner system at the armrest, and kinematically interconnecting the body-supporting means to the base for reciprocal movement of the body-supporting means relative to the base in forward and rearward directions along a path which extends between an end-limiting upright chair position in which the body-supporting means is oriented at a predetermined orientation relative to the base, and an end-limiting fully-reclined chair position in which the body-supporting means is oriented at a different reclined orientation relative to the base;

the improvement which comprises:

(a) manually-actuatable means for driving the recliner system and for moving the body-supporting means along the path only in the forward direction from the upright chair position towards an intermediate chair position which is intermediate the end-limiting chair positions, (b) said manually-actuatable means including an actuator member mounted on the armrest within hand-reach of a seated user, for displacement along a working stroke from a first position which corresponds to the upright chair position, to a second position which corresponds to the intermediate chair position, (c) said manually-actuatable means being in force-transmitting relationship with, and affirmatively forwardly driving, the recliner system throughout the displacement of the actuator member as it is being displaced from its first position towards its second position, and for thereby forwardly moving the body-supporting means downstream of the path towards the intermediate chair position, (d) said manually-actuatable means being in impositive engagement, and out of force-transmitting relationship with, the recliner system when the actuator member reaches the second position, to thereby disengage the manually-actuatable means from the recliner system and permit the body-supporting means to be moved forwardly further downstream of the path to the fully-reclined position in response to the body weight of the seated user acting on the recliner system, and (e) said actuator member being returnable from its second position to its first position upon disengagement of the manually-actuatable means from the recliner system when the actuator member reaches its second position.

2. The improvement as defined in claim 1, wherein said actuator means is a handle having a handle portion which is more elevated relative to the base in its second position as compared to its first position, and wherein said handle is freely returnable under the influence of gravity from its more elevated second position to its less elevated first position upon said disengagement of the manually-actuatable means from the recliner system.

3. The improvement as defined in claim 1, wherein said actuator member is a handle mounted on the armrest for pivoting movement about a pivot axis along an operating stroke which extends from one handle end position to an opposite handle end position; and wherein said working stroke is shorter than said operating stroke.

4. The improvement as defined in claim 3, wherein said handle pivots about the pivot axis through an arc length of approximately 90° for the operating stroke, and through an arc length which ranges from approximately 30° to about 45° for the working stroke.

5. The improvement as defined in claim 3, wherein said handle is elongated and extends generally vertically in said one handle end position, and extends generally horizontally in said opposite handle end position.

6. The improvement as defined in claim 3, wherein said actuator member is a handle mounted on the armrest for pivoting movement about a pivot axis; and wherein the manually-actuatable means further includes stop means for preventing the user from turning the handle forwardly about the pivot axis, and concomitantly for compelling the user to turn the handle rearwardly about the pivot axis.

7. The improvement as defined in claim 1, wherein said actuator member is a handle mounted on the armrest for pivotal displacement about a pivot axis along an operating stroke; and wherein the manually-actuatable means includes an elongated drive link operatively connected between the recliner system and the handle; and wherein the drive link is longer than the handle and is moved through a distance which is less than that of the operating stroke to thereby obtain a mechanical advantage for easily moving the recliner system between its chair positions with a short handle.

8. The improvement as defined in claim 1, and further comprising alternate means for forwardly moving the recliner system from the upright chair position towards the intermediate chair position independently of the displacement of the acutator member, said alternate means including another armrest located at the side of the chair which is opposite to the side where the first-mentioned armrest is located, both of the armrests being interconnected and stationarily mounted on the base to thereby constitute a stationary chair chassis which serves as a reaction member against which a user may pull himself, the recliner system and the body-supporting means forwardly towards the intermediate chair position.

9. The improvement as defined in claim 1, wherein the chair further comprises another armrest located at the side of the chair which is opposite to the side where the first-mentioned armrest is located, another body-supporting means mounted on the chair intermediate the two armrests, another recliner system at the other armrest, and another manually-actuatable means having its respective actuator member mounted on the other armrest; and wherein each respective manually-actuatable means is operative for moving its respective recliner system and body-supporting means independently of the operation of the other manually-acutatable means.

10. The improvement as defined in claim 1; and further comprising another armrest located at the opposite side of the chair, and another recliner system at the other armrest; and further comprising means for interconnecting the recliner systems for joint movement.

11. The improvement as defined in claim 1, wherein the chair further comprises a footrest, and a footrest drive system kinematically interconnecting the footrest to the recliner system for reciprocal movement of the footrest relative to the base from an end-limiting storage position which corresponds to the upright chair position of the recliner system, to an end-limiting fully-extended position which corresponds to the fully-reclined chair position of the recliner system.

12. The improvement as defined in claim 11, wherein the foot-rest drive system and the recliner system are both comprised of a plurality of links all integrally kinematically interconnected to constitute and integrated all-linkage system.

13. The improvement as defined in claim 1, wherein said body-supporting means includes an elongated seat-mounting member located at one side of the seat, and wherein the armrest includes an elongated armrest-mounting member located at the same side of the seat, and wherein the armrest is stationarily mounted on the base for non-movement relative thereto; and wherein the recliner system includes an elongated front seat carrier link having two spaced-apart parts thereof pivotally connected to forward portions of the seat-mounting member and the armrest-mounting member, respectively; and wherein the recliner system includes an elongated rear seat carrier link having two spaced-apart parts thereof pivotally connected to rearward portions of the seat-mounting member and the arm-rest-mounting member, respectively; and wherein the seat-mounting member, the armrest-mounting member, the front seat carrier link and the rear seat carrier link together constitute a four-bar linkage.

14. The improvement as defined in claim 13, wherein the front and rear seat carrier links are oriented generally vertically when the recliner system is in the upright chair position; and wherein the manually-actuatable means includes a drive link operatively connected to the four-bar linkage, for inclining the front and rear carrier links such that their respective upper parts are moved forwardly when the recliner system is in the intermediate chair position.

15. The improvement as defined in claim 14, wherein said manually-actuatable means includes a driven member operatively connected to the four-bar linkage in force-transmitting relationship therewith, and wherein said drive link physically and drivingly engages the driver member as the actuator member is being displaced from its first position towards its second position, and wherein said drive link is physically and drivingly disengaged from the driver member when the actuator member reaches the second position.

16. The improvement as defined in claim 1, wherein said manually-actuatable means includes a handle bracket mounted on the armrest; and wherein said actuator member is a handle mounted on the handle bracket for pivoting movement about a pivot axis along an operating stroke which extends from one handle end position to an opposite handle end position; and wherein said manually-actuatable means further includes an elongated handle link connected to the handle for joint movement therewith; a stop member mounted on the handle link and engaging the handle bracket at one of said handle end positions to prevent movement of the handle past said one handle end position; an elongated connector link having one end portion pivotally connected to the handle link; an elongated drive link having one end pivotally connected to the opposite end portion of the connector link; an extension member pivotally connected to the opposite end of the drive link and being connected to the recliner system for movement therewith; and a driven member mounted on the extension member and physically engaging the drive link at a region intermediate the opposite ends thereof as the handle is being displaced from its first position towards its second position; said driven member being physically disengaged from the drive link when the handle reaches its second position.

17. The improvement as defined in claim 1, wherein said body-supporting means includes an elongated seat-mounting member located at one side of the seat, and wherein the base includes an elongated base-mounting member located at the same side of the seat, and wherein the armrest is stationarily mounted on the body-supporting means for non-movement relative thereto; and wherein the recliner system includes an elongated front seat carrier link having two spaced-apart parts thereof pivotally connected to forward portions of the seat-mounting member and the base-mounting member, respectively; and wherein the recliner system includes an elongated rear seat carrier link having two spaced-apart parts thereof pivotally connected to rearward portions of the seat-mounting member and the base-mounting member, respectively; and wherein the seat-mounting member, and the base-mounting member, the front seat carrier link and the rear seat carrier link together constitute a four-bar linkage.

18. The improvement as defined in claim 17, wherein the front and rear seat carrier links are oriented generally vertically when the recliner system is in the upright position; and wherein the manually-actuatable means includes a drive link operatively connected to the four-bar linkage, for inclining the front and rear seat carrier links such that their respective upper parts are moved forwardly when the recliner system is in the intermediate chair position.

19. The improvement as defined in claim 18, wherein said manually-actuatable means includes a driven member operatively connected to the four-bar linkage in force-transmitting relationship therewith, and wherein said drive link physically and drivingly engages the driven member as the actuator member is being displaced from its first position towards its second position, and wherein said drive link is physically an drivingly disengaged from the driven member when the actuator member reaches the second position.

20. The improvement as defined in claim 1, wherein said manually-actuatable means includes a handle bracket mounted on the armrest; and wherein said actuator member is a handle mounted on the handle bracket for pivoting movement about a pivot axis along an operating stroke which extends from one handle end position to an opposite handle end position; and wherein said manually-actuatable means further includes an elongated handle link connected to the handle for joint movement therewith; a stop member mounted on the handle link and engaging the handle bracket at one of said handle end positions to prevent movement of the handle past said one handle end position; an elongated connector link having one end portion pivotally connected to the handle link; a drive bell crank link having one end pivotally connected to the opposite end portion of the connector link, another end pivotally connected to the seat-mounting member, and a drive member mounted on the drive bell crank link intermediate the ends thereof; a driven link subassembly kinematically connected to the recliner system for forwardly moving the latter; said drive member physically engaging the driven link sub-assembly as the handle is being displaced from its first position towards its second position, and being physically disengaged from the driven link sub-assembly when the handle reaches its second position.

21. The improvement as defined in claim 20, wherein the driven link sub-assembly includes an elongated idler link having one end pivotally connected to the seat-mounting member; and an elongated rear drag link having one end pivotally connected to the idler link, and its opposite end pivotally connected to the recliner system.

22. The improvement as defined in claim 21, wherein the chair further comprises a footrest, and a footrest drive system kinematically interconnecting the footrest to the recliner system for reciprocal movement of the footrest relative to the base from an end-limiting storage position to an end-limiting fully-extended position; and wherein said footrest drive system includes an elongated front push link having one end operatively connected to the footrest, and its other end pivotally connected to the opposite end of the idler link to thereby forwardly drive the footrest drive system simultaneously with the recliner system.

* * * * *